US005327764A

United States Patent [19]

Weykamp et al.

[11] Patent Number: 5,327,764

[45] Date of Patent: Jul. 12, 1994

[54] APPARATUS AND METHOD FOR THE STRETCH FORMING OF ELONGATED HOLLOW METAL SECTIONS

[75] Inventors: Robert E. Weykamp, Plum Boro; Robert P. Evert, Allison Park, both of Pa.

[73] Assignee: Aluminum Company of America, Pittsburgh, Pa.

[21] Appl. No.: 42,549

[22] Filed: Apr. 5, 1993

[51] Int. Cl.[5] ..... B21D 11/02; B21D 26/02

[52] U.S. Cl. ..... 72/296; 72/61

[58] Field of Search ..... 72/296, 297, 58, 57, 72/61, 62

[56] References Cited

U.S. PATENT DOCUMENTS

| | | | |
|---|---|---|---|
| 2,693,637 | 11/1954 | Peabody et al. | 29/550 |
| 2,729,265 | 1/1956 | Jones | 153/32 |
| 2,868,264 | 1/1959 | Jones | 153/51 |
| 2,986,194 | 5/1961 | DeMarco | 72/297 |
| 3,314,269 | 4/1967 | MacKenzie | 72/296 |
| 3,452,573 | 7/1969 | MacKenzie | 72/296 |
| 4,567,743 | 2/1986 | Cudini | 72/61 |
| 4,803,878 | 2/1989 | Moroney | 72/296 |
| 5,070,717 | 12/1991 | Boyd et al. | 72/55 |
| 5,107,693 | 4/1992 | Olszewski et al. | 72/58 |
| 5,214,951 | 6/1993 | Waddell | 72/60 |

FOREIGN PATENT DOCUMENTS

| | | | |
|---|---|---|---|
| 212814 | 12/1983 | Japan | 72/297 |

*Primary Examiner*—Daniel C. Crane

*Attorney, Agent, or Firm*—John I. Iverson; Thomas R. Trempus

[57] ABSTRACT

Disclosed is apparatus and a method for the stretch forming of an elongated hollow metal section, such as an aluminum extrusion. The apparatus and method uses one or more constraining means secured to the forming die and a die extension to constrain and support the walls of the elongated hollow metal section against the forces produced by air pressure within the interior of the hollow metal section. The apparatus and methods disclosed herein prevent the formation of wrinkles, crimps and bulges in the walls of the elongated hollow metal section during the stretch forming and reshaping thereof.

14 Claims, 4 Drawing Sheets

APPARATUS AND METHOD FOR THE STRETCH FORMING OF ELONGATED HOLLOW METAL SECTIONS

BACKGROUND OF THE INVENTION

This invention relates to apparatus and methods for the forming of elongated hollow metal sections into a predetermined shape or contour. It relates particularly to apparatus and methods for the bending or reshaping of elongated hollow metal sections, such as aluminum extrusions, using "stretch forming" apparatus and methods. The stretch forming process for bending or shaping of an aluminum extrusion involves placing the ends of the elongated hollow extrusion into an opposed pair of jaws or clamps attached to a pair of opposed hydraulic cylinders and then applying sufficient tension through the hydraulic cylinders and jaws or clamps on the ends of the extrusion to "stretch" the metal in the extrusion beyond its yield point or elastic limit. While the metal is tensioned above the elastic limit, a forming die of desired shape and contour is pressed against the extrusion causing the extrusion to assume the desired shape and contour of the forming die. The tension on the ends of the extrusion is then reduced and the newly shaped extrusion is removed from the forming die and the stretch forming apparatus.

In the past, the stretch forming of elongated hollow metal sections, and especially thin walled aluminum extrusions, often produced crimps or wrinkles in certain portions of the sections or extrusion walls as a result of the inability of the walls of the section or extrusion to resist the reshaping forces during the stretch forming operation. Such crimps and wrinkles not only weakened the final section but also resulted in an extrusion of unacceptable appearance.

While in some cases the crimps and wrinkles could be eliminated by using a thicker walled section, such a solution added to the cost of the finished product and increased its weight. U.S. Pat. No. 4,803,878 issued Feb. 14, 1989 to Moroney not only discloses the above-described process for stretch forming of elongated hollow metal sections or extrusions, but also discloses one proposed solution to eliminate the crimps and wrinkles formed in the shaping of thin walled extrusions. Moroney suggests that the crimps and wrinkles can be reduced or eliminated by introducing a gas under pressure into the interior of the elongated hollow metal section or extrusion while it is being stretch formed. Moroney claims that the internal gas pressure is sufficient to support the internal walls of the extrusion during the stretch forming operation and will prevent the formation of crimps and wrinkles. While the use of an internal pressurized gas has helped to reduce the formation of crimps and wrinkles, the use of the internal pressurized gas alone has not completely eliminated the crimps and wrinkles and in some instances, produced bulging of the thin walls of the hollow metal section or extrusion and again resulting in an unacceptable finished product.

SUMMARY OF THE INVENTION

It is therefore an object of this invention to provide apparatus and methods useful for the stretch forming of elongated hollow metal sections which will prevent the crimping, wrinkling or bulging of the elongated hollow metal section.

It is another object of this invention to provide apparatus and methods that allow the stretch forming of elongated hollow metal sections into a finished product having accurate dimensions, contours and a smooth appearance.

It is still another object of this invention to provide apparatus and methods for the stretch forming of elongated hollow metal sections that can be easily adapted to existing stretch forming equipment and manufacturing practices.

It is another object of this invention to provide apparatus and methods for the stretch forming of elongated hollow metal sections that can be adapted for the forming and shaping of a wide variety of cross-sections of elongated hollow metal sections and extrusions.

We have discovered that the foregoing objects can be attained by providing apparatus and methods for the stretch forming of an elongated hollow metal section into a predetermined contour comprising means to grip the opposed ends of the elongated hollow metal section, a forming die member having a forming die face and a die cavity in the die face adapted to receive the elongated hollow metal section. The apparatus includes means to tension the elongated hollow metal section above its elastic limit. The apparatus of this invention includes at least one constraining means secured to the forming die face and adapted to constrain at least one surface of the elongated hollow metal section while it is contained in the die cavity during the tensioning thereof.

DESCRIPTION OF THE PREFERRED EMBODIMENTS

Figure 1:
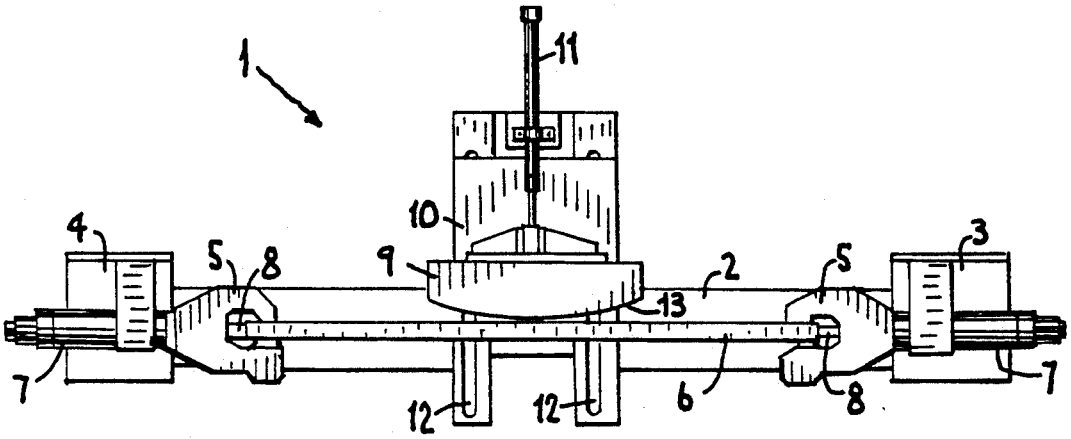
FIG. 1 is a top plan view of a typical stretch forming apparatus used to reshape elongated hollow metal sections and illustrating the apparatus with a hollow metal section in the apparatus prior to the stretch forming operation.
Figure 2:
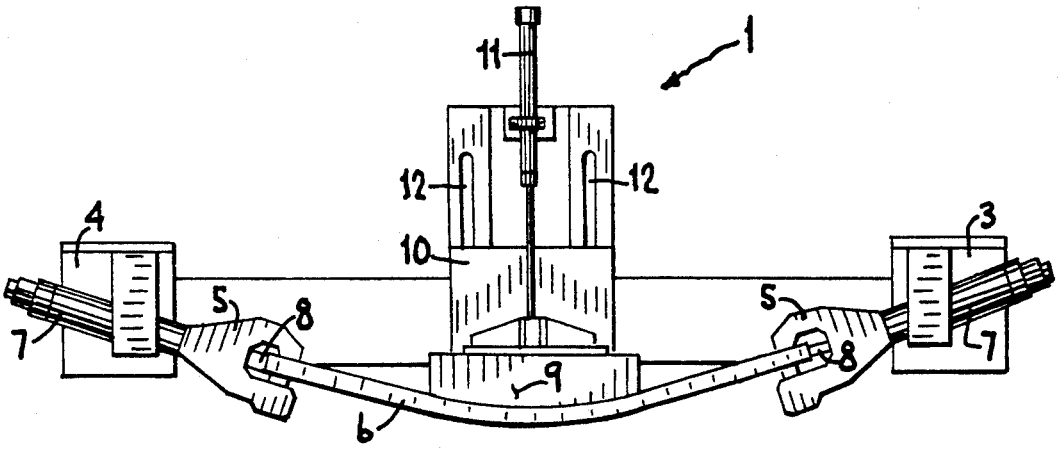
FIG. 2 is a top plan view of the same stretch forming apparatus shown in FIG. 1, illustrating the hollow metal section as it is being stretch formed by the forming die while the metal in the hollow metal section is tensioned above its elastic limit.
Figure 3A:
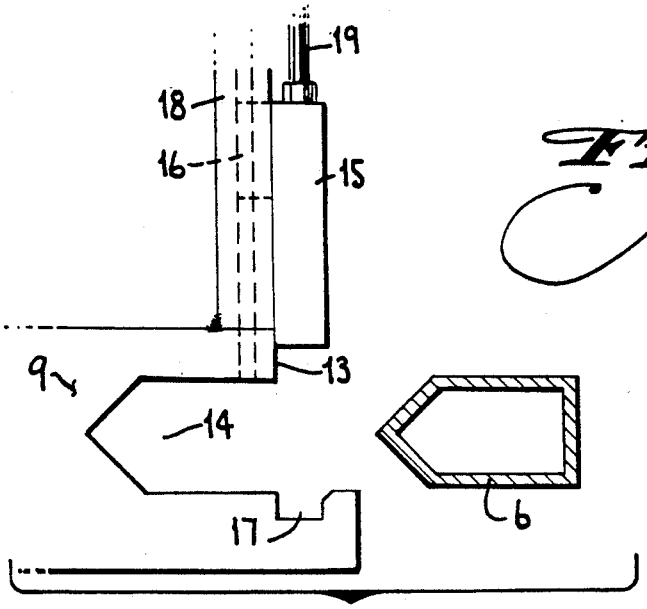
FIG. 3*a* is a side sectional view of a first embodiment of the constraining means used in the apparatus of this invention prior to the stretch forming of the hollow metal section.
Figure 3B:
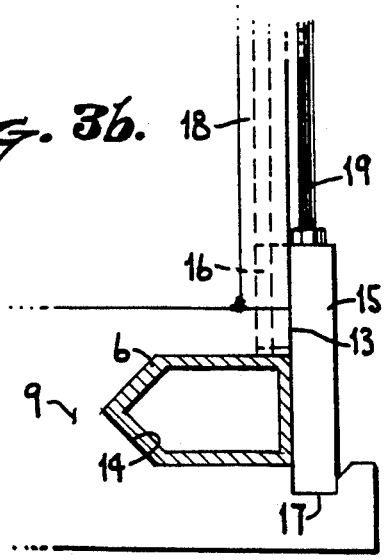
FIG. 3*b* is a side sectional view of a first embodiment of the constraining means used in the apparatus of this invention during the stretch forming of the hollow metal section.

FIGS. 1 and 2 illustrate a typical known apparatus and procedure used commercially to stretch form an elongated hollow metal section, such as an aluminum extrusion. As shown in FIGS. 1 and 2, the stretch forming apparatus 1 comprises an elongated foundation bed or table 2 having a pair of carriages 3 and 4 at each end of the bed or table 2. The carriages 3 and 4 are positioned on the bed or table 2 a suitable distance apart for the length of the extrusion to be stretch formed and then locked into place. The carriages 3 and 4 do not move during the stretch forming operation.

Each of the carriages 3 and 4 is equipped with a clamp or jaws 5 which are designed to tightly grip and hold the ends of the extrusion 6 to be reshaped and stretch formed. Each of the carriages 3 and 4 are also provided with hydraulic pistons and cylinders 7 to provide a tensioning force to the ends of the extrusion 6 when gripped in the clamps or jaws 5.

In a preferred version of the stretch forming apparatus 1, as further described in the above-mentioned U.S. Pat. No. 4,803,878 to Moroney, which is incorporated by reference herein, the clamps or jaws 5 are provided with special mandrels 8 which are designed to fit tightly into the ends of the extrusion 6 when they are held by the clamps or jaws 5. The mandrels 8 are shaped in a cross-section to conform to the cross-section of the interior of the extrusion 6 and are provided with elastomeric seals which provide an airtight seal to the interior of the extrusion 6. Pressurized air is then pumped into the interior of the extrusion 6 through inlets in the mandrels 8 to maintain the interior of the extrusion 6 at a greater than atmospheric pressure during the stretch forming operation.

The stretch forming apparatus 1 is provided with a die member 9 mounted on a movable die carriage 10. The die carriage 10 and the die member 9 are able to be moved transversely to the axis of the foundation bed or table 2 along parallel guide rails 12 by a hydraulic piston and cylinder 11. The die member 9 has a die face portion 13 shaped to provide the desired curve or contour to the extrusion 6 and is usually also provided with a die cavity 14 machined into the die face portion 13, as illustrated in FIG. *3a*, to accommodate at least a portion of the cross-section of the extrusion 6 be stretch formed.

As shown in FIG. 2, the reshaping or stretch forming of the extrusion 6 is performed by first activating the tension pistons and cylinders 7 attached to the clamps or jaws 5 which tightly hold the ends of the extrusion 6. Enough tension is applied to the ends of the extrusion 6 to exceed the elastic limit of the metal in the extrusion and thereby place the metal in the "yield state" where the metal is susceptible to easy reshaping and forming. Once the metal is tensioned to the "yield state", the die carriage 10 and the die member 9 are moved forward by the hydraulic piston and cylinder 11 along the guides 12 until the die member reshapes the extrusion 6 into the desired contour or shape, as illustrated in FIG. 2. As illustrated by FIG. 2 and described in the above-mentioned U.S. Pat. No. 4,803,878 to Moroney, the clamps or jaws 5 are permitted to pivot to provide the proper angle tangent to the curve being formed in the extrusion 6.

During the reshaping operation by the die member 9, the air pressure in the interior of the extrusion is maintained a level high enough to resist any forces that would tend to wrinkle or crimp the walls of the extrusion 6.

In FIGS. *3a*, *3b* and 4, we have illustrated a first embodiment of the apparatus of this invention. In FIGS. *3a*, *3b* and 4, the forming die member 9 of the stretch forming apparatus 1, illustrated generally in FIGS. 1 and 2, is provided with a die face portion 13 conforming to the desired curvature of the finished product and a die cavity 14 designed to receive the cross-sectional shape of the extrusion 6. The die face portion 13 of the die member 9 is provided with a plate-like constraining means 15 shaped to fit tightly against the die face portion 13 and that portion of the outer wall surface of the extrusion 6 that is not contained in the die cavity 14.

Figure 4:
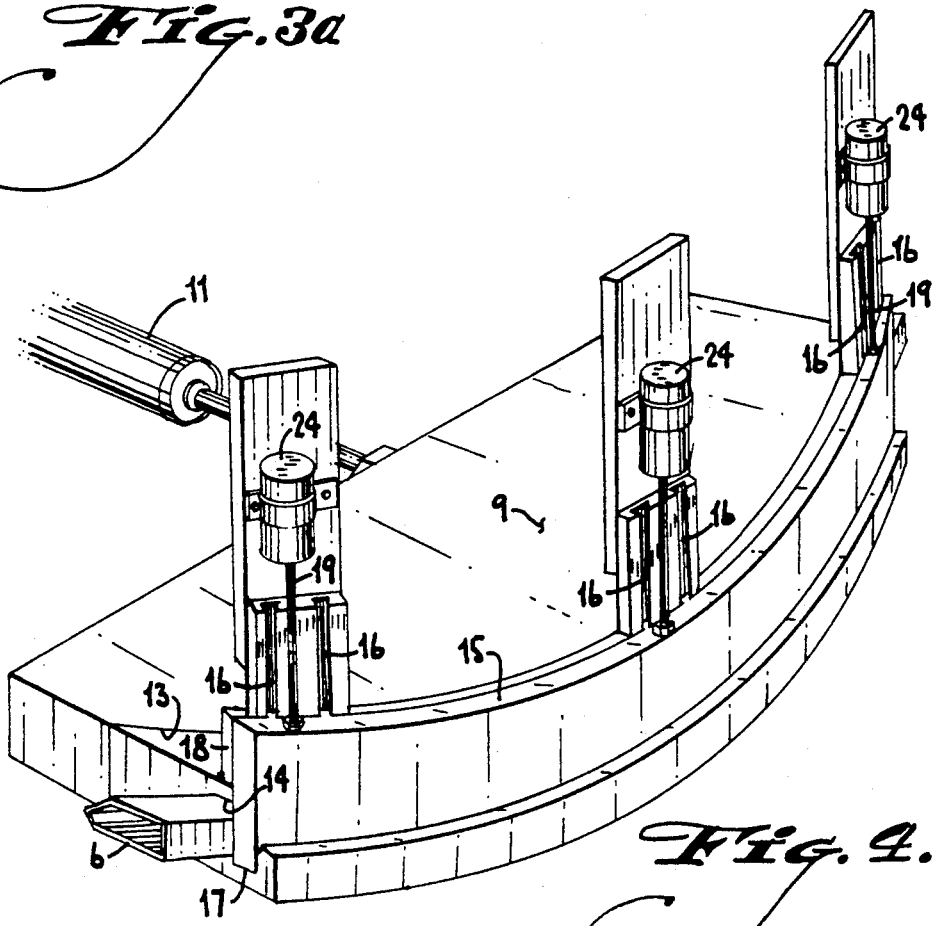
FIG. 4 is an isometric view of the first embodiment of the constraining means used in the apparatus of this invention.

The plate-like constraining means 15 is secured to several portions of the die face portion 13 with dovetail tongues and grooves 16 and an end receiving recess 17 formed in the base of the die member 9, as shown in FIGS. *3a*, *3b* and 4. In this embodiment, a support member 18 is attached to the top of the die member 9 and is also provided with a series of dovetail tongues and grooves 16 to allow the plate-like constraining member 15 to be moved vertically up and down across the die face portion 13 by one or more hydraulic piston and cylinders 24 attached to push rods 19. For some stretch forming applications, it may be desirable to make the plate-like constraining member 15 as several adjacent or interlocking segments instead of a single piece as shown in FIG. 4.

After the extrusion 6 has been reshaped to the desired contour conforming to the shape of the die face portion 13, the plate-like constraining member 15 is lowered down across the die face portion 13 and into the recess 17 where it will bear tightly against the exterior wall of the extrusion 6 that is not contained in the die cavity 14. The air pressure within the interior of the extrusion 6 is then increased by pumping air in through the special end mandrels 8 which causes the walls and exterior of the extrusion 6 to conform exactly to the internal shape of the die cavity 14 without producing any wrinkles, crimps or bulges on the finished reshaped extrusion 6.

The air pressure within the interior of the extrusion 6 is then reduced to atmospheric and the tension on the ends of the extrusion 6 released. The plate-like constraining means 15 is then raised up from the die face portion 13 by the push rods 19 and the hydraulic piston and cylinders 24. The reshaped extrusion 6 is then removed from the die cavity 14.

Figure 5:
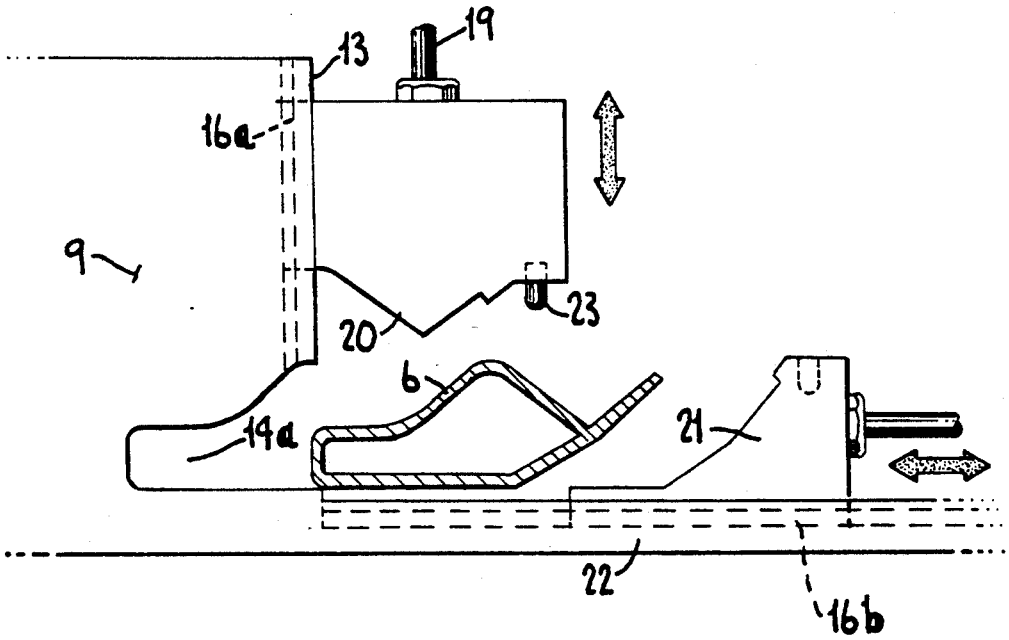
FIG. 5 is a side sectional view of a second embodiment of the constraining means used in the apparatus of this invention prior to the stretch forming of the hollow metal section.
Figure 6:
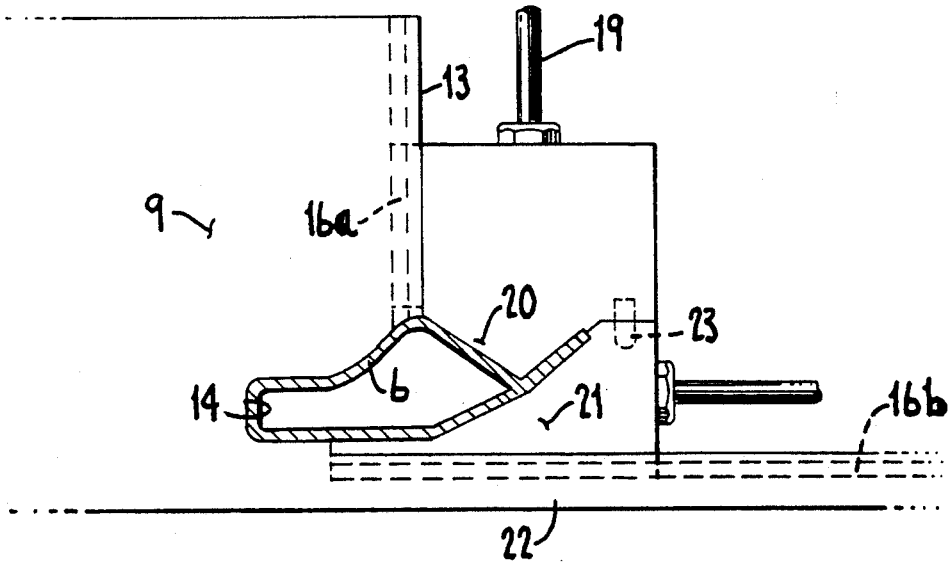
FIG. 6 is a side sectional view of a second embodiment of the constraining means used in the apparatus of this invention during the stretch forming of the hollow metal section.
Figure 7:
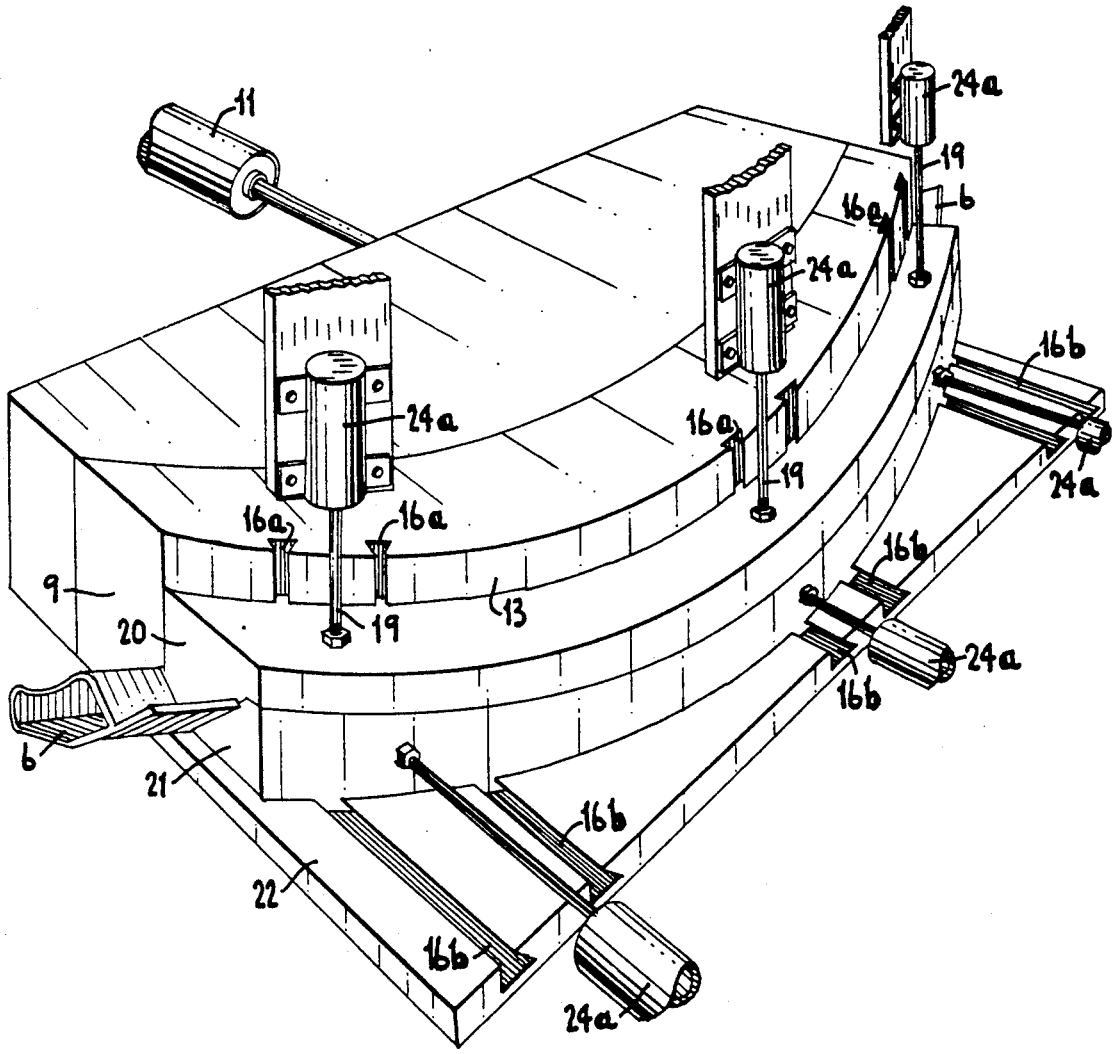
FIG. 7 is an isometric view of a second embodiment of the constraining means used in the apparatus of this invention.

FIGS. 5, 6 and 7 illustrate a second embodiment of this invention designed to be used with more complex cross-sectional shaped elongated hollow metal sections or extrusions.

In this second embodiment, the die cavity **14*a* in the die member 9 is designed to receive only a portion of the extrusion 6. A first external constraining means or mandrel 20 acts to constrain one or more wall surfaces of the extrusion 6 and is preferably secured to the die face portion 13 with a plurality of dovetail tongue and grooves 16*a*. This arrangement permits the first external constraining means or mandrel 20 to be moved up and down in a vertical direction indicated by the arrows shown on FIGS. 5 and 6. In this second embodiment, a second external constraining means or mandrel 21 is provided with a plurality of dovetail tongues and grooves 16*b* which secure it to a die extension 22 attached to the bottom of the die member 9 and allow the second mandrel 21 to move forward and backward relative to the die face portion 13 as indicated by the arrows shown in FIGS. 5 and 6**.

The first and second external constraining means or mandrels 20 and 21, either single pieces as shown in FIG. 7, or made as several adjacent or interlocking segments, and are machined to conform to the exterior cross section shape of one or more of the walls of the extrusion 6. The external constraining means or mandrels 20 and 21 are slid into position against the extrusion 6 and the die face portion 13 by hydraulic pistons and cylinders 24*a* during the reshaping or after the extrusion 6 has been initially reshaped to the desired contour conforming to the shape of the die face portion 13 and may be locked together with a plurality of pins 23. The air pressure within the interior of the extrusion 6 is then increased and causes the walls and exterior of the extrusion 6 to conform exactly to the internal shape of the die cavity 14*a* and the machined surfaces of the first and second external constraining means or mandrels 20 and 21 without producing any wrinkles, crimps or bulges on the finished reformed extrusion 6.

The mandrels 20 and 21, as best illustrated in FIG. 6, can also serve to dies to reshape a flange on the extrusion 6 that is or may be deformed during the reshaping of the hollow portions of the extrusion 6. If required the hydraulic pistons and cylinders 24*a* could supply sufficient force on the mandrels 20 and 21 to assist in the reshaping of a flange, if necessary.

It is understood that these two embodiments are just examples of the stretch forming apparatus of this invention and are provided for the purposes of illustrating this invention and not for the purpose of limitation.

We claim:

1. Apparatus for the stretch forming of an elongated hollow metal section into a predetermined contour, comprising means to grip the opposed ends of said elongated hollow metal section, a forming die member having a forming die face and a die cavity in said die face adapted to receive at least a portion of said elongated hollow metal section, means to tension said elongated hollow metal section above its elastic limit, and at least one constraining means slidably secured directly to said forming die member and adapted to constrain those exterior surfaces of said portion of said hollow metal section that are adjacent to but not contained in said die cavity during the stretch forming thereof.

2. The apparatus of claim 1 in which said constraining means is a flat plate slidably secured to said forming die face.

3. The apparatus of claim 1 in which said constraining means is adapted to move vertically against said forming die face.

4. The apparatus of claim 1 in which said constraining means is secured to said forming die face by tongue and groove connection means.

5. The apparatus of claim 1 in which said constraining means is moved against said forming die face by power means.

6. The apparatus of claim 5 in which the power means is one or more hydraulic piston and cylinders.

7. The apparatus of claim 1 in which said constraining means fits into a recess formed in the base of an extension to said forming die member.

8. The apparatus of claim 7 in which a first constraining means is slidably secured to said forming die face and a second constraining means is slidably secured to the base of said forming die member.

9. The apparatus of claim 8 in which the first constraining means is adapted to move generally vertically and said second constraining means is adapted to move generally horizontally.

10. The apparatus of claim 8 in which the first constraining means and the second constraining means are adapted to reshape a flange on said hollow metal section.

11. The apparatus of claim 1 having means to introduce a fluid under pressure into the interior of said elongated hollow metal section to force the walls of said elongate hollow metal section against said constraining means.

12. A method for the stretch forming of an elongated hollow metal section comprising the steps of gripping the opposed ends of said metal section and applying a tension to said metal section above its elastic limit, reshaping said metal section against a die member having a die cavity capable of receiving at least a portion of said metal section while said metal section is tensioned, placing one or more constraining means slidably secured to said die member about those portions of said metal section not received in said die cavity and introducing air at greater than atmospheric pressure into the interior of said metal section whereby said metal section is shaped to conform to the shape of said die cavity and said constraining means.

13. The method of claim 12 in which said metal section is reshaped initially by said die member and reshaped finally by the air at greater than atmospheric pressure.

14. The method of claim 12 in which the air at greater than atmospheric pressure is introduced through the ends of the metal section.

* * * * *